US010491995B1

(12) United States Patent
Enstad et al.

(10) Patent No.: US 10,491,995 B1
(45) Date of Patent: Nov. 26, 2019

(54) DIRECTIONAL AUDIO PICKUP IN COLLABORATION ENDPOINTS

(71) Applicant: Cisco Technology, Inc., San Jose, CA (US)

(72) Inventors: Gisle Langen Enstad, Oslo (NO); Haohai Sun, Nesbru (NO); Johan Ludvig Nielsen, Oslo (NO)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 16/157,550

(22) Filed: Oct. 11, 2018

(51) Int. Cl.

| | |
|---|---|
| ***H04R 3/00*** | (2006.01) |
| ***H04R 1/00*** | (2006.01) |
| ***H04R 3/04*** | (2006.01) |
| ***H04R 1/40*** | (2006.01) |

(52) U.S. Cl.
CPC ..... *H04R 3/005* (2013.01); *H04R 1/406* (2013.01); *H04R 3/04* (2013.01); *H04R 2201/405* (2013.01)

(58) Field of Classification Search
CPC .... H04R 3/04; H04R 3/005; H04R 2201/405; H04R 1/406
See application file for complete search history.

(56) References Cited

U.S. PATENT DOCUMENTS

| | | | |
|---|---|---|---|
| 8,437,490 B2 | 5/2013 | Marton | |
| 9,367,898 B2 | 6/2016 | Jothiswaran et al. | |
| 2006/0034469 A1* | 2/2006 | Tamiya | H04M 3/56 381/97 |
| 2006/0093128 A1* | 5/2006 | Oxford | H04M 9/082 379/406.01 |
| 2014/0211950 A1* | 7/2014 | Neufeld | H04R 5/04 381/23 |

(Continued)

FOREIGN PATENT DOCUMENTS

| | | |
|---|---|---|
| CN | 103995252 A | 8/2014 |

OTHER PUBLICATIONS

Ashok Kumar Tellakula, "Acoustic Source Localization Using Time Delay Estimation", A Thesis Submitted for the Degree of Master of Science (Engineering) in Faculty of Engineering, Supercomputed Education and Research Centre, Indian Institute of Science, Bangalore—560 012 (India), Aug. 2007, 82 pages.

(Continued)

*Primary Examiner* — Regina N Holder
(74) *Attorney, Agent, or Firm* — Edell, Shapiro & Finnan, LLC

(57) ABSTRACT

A microphone array includes one or more front-facing microphones disposed on a front surface of the collaboration endpoint and a plurality of secondary microphones disposed on a second surface of the collaboration endpoint. The sound signals received at each of the one or more front-facing microphones and the plurality of secondary microphones are converted into microphone signals. When the sound signals have a frequency below a threshold frequency, an output signal is generated from microphone signals generated by the one or more front-facing microphones and the plurality of secondary microphones. When the sound signals have a frequency at or above a threshold frequency, an output signal is generated from microphone signals generated by only the one or more front-facing microphones.

20 Claims, 6 Drawing Sheets

(56) References Cited

U.S. PATENT DOCUMENTS

2017/0070814 A1* 3/2017 Lu ..... H04R 3/005

OTHER PUBLICATIONS

M. Omer, et al., "An L-shaped microphone array configuration for impulsive acoustic source localization in 2-D using orthogonal clustering based time delay estimation", Conference paper, Feb. 2013, DOI: 10.1109/ICCSPA.2013.6487241, ResearchGate, 7 pages.
Simon Doclo, et al., "Acoustic Beamforming for Hearing Aid Applications", Handbook on Array Processing and Sensor Networks, Feb. 2010, 34 pages.
Hidri Adel, et al., "Beamforming Techniques for Multichannel audio Signal Separation", JDCTA: International Journal of Digital Content Technology and its Applications, vol. 6, No. 20, arXiv:1212.6080v1, Dec. 2012, 9 pages.
Mark Aarts, et al., "Two Sensor Array Beamforming Algorithm", for Android Smartphones, Jul. 4, 2012, TUDelft, https://repository.tudelft.nl/islandora/object/uuid:7b7b6fda-3446-49ee-84b0-4b7540914b80, 45 pages.
Andrea Trucco, et al., "Maximum Constrained Directivity of Oversteered End-Fire Sensor Arrays", Sensors 2015, 15, 13477-13502; doi:10.3390/s150613477, www.mdpi.com/journals/sensors, ISSN 1424-8220, Jun. 9, 2015, 26 pages.
Application Note, "Microphone Array Beamforming", IvenSense, AN-1140-00, Revision 1.0, Dec. 31, 2013, 12 pages.
Yu Jingzhou, et al., "End-Fire Microphone Array Based on Phase Difference Enhancement Algorithm", ICSP2010, Oct. 24-28, 2010, Beijing, China, DOI: 10.1109/ICOSP.2010.5656250, 4 pages.
Barry D. Van Veen, et al., "Beamforming: A Versatile Approach to Spatial Filtering", IEEE ASSP Magazine, Apr. 1988, 21 pages.

* cited by examiner

DIRECTIONAL AUDIO PICKUP IN COLLABORATION ENDPOINTS

TECHNICAL FIELD

The present disclosure relates to audio processing in collaboration endpoints.

BACKGROUND

There are currently a number of different types of audio and/or video conferencing or collaboration endpoints (collectively "collaboration endpoints") available from a number of different vendors. These collaboration endpoints may comprise, for example, video endpoints, immersive endpoints, etc., and typically include an integrated microphone system. The integrated microphone system is used to receive/capture sound signals (audio) from within a sound environment (e.g., meeting room). The received sound signals may be further processed at the collaboration endpoint or another device.

DESCRIPTION OF EXAMPLE EMBODIMENTS

Overview

Figure 1A:
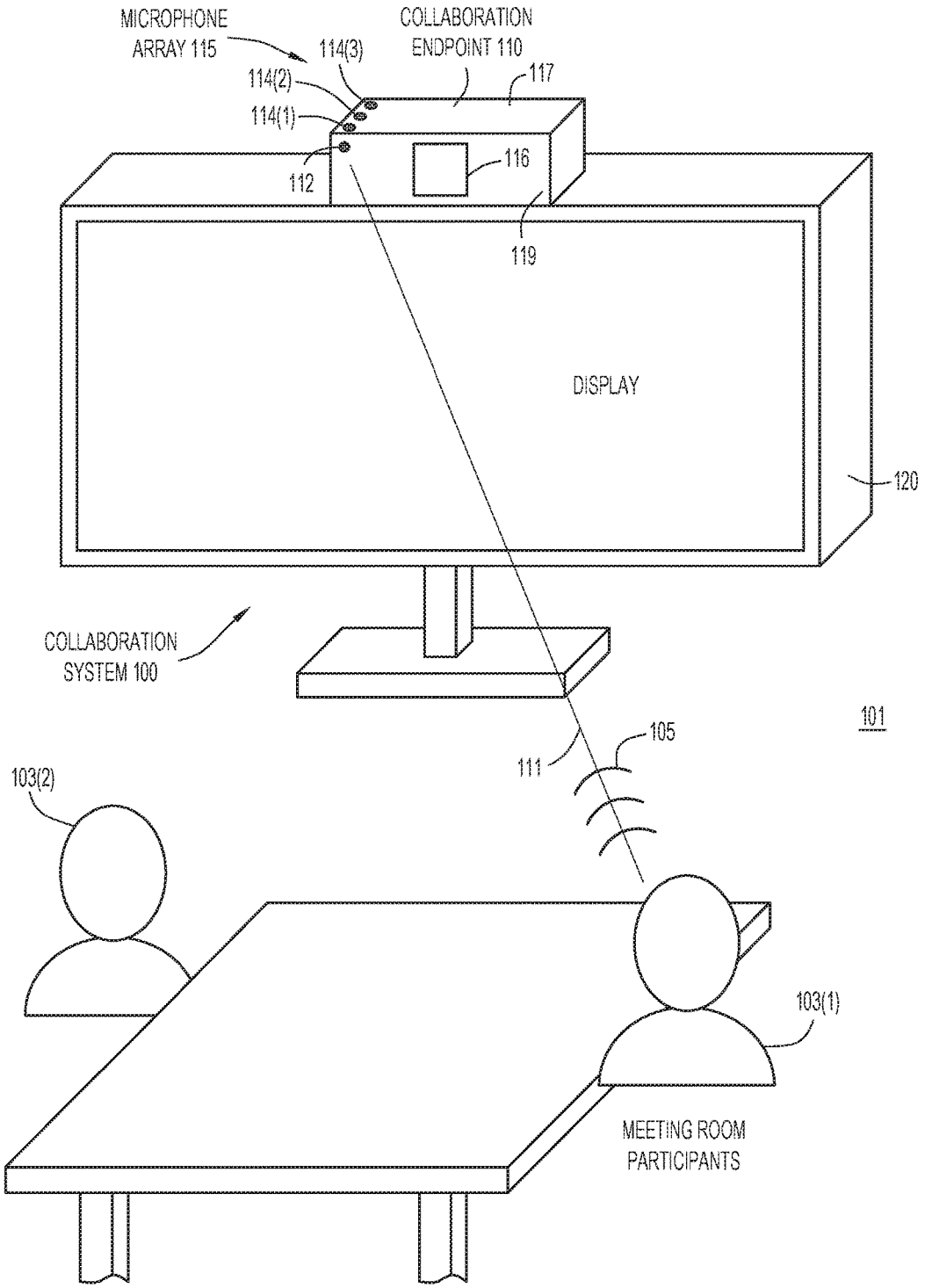
FIG. 1A is a simplified block diagram illustrating a collaboration endpoint positioned in a sound environment, according to an example embodiment.

Presented herein are techniques in which sound signals are received with/via a microphone array of a collaboration endpoint. The microphone array includes one or more front-facing microphones disposed on a front surface of the collaboration endpoint (i.e., a surface facing one or more target sound sources) and a plurality of secondary microphones disposed on a second surface of the collaboration endpoint (i.e., a surface that is substantially orthogonal to the front surface). The sound signals received at each of the one or more front-facing microphones and the plurality of secondary microphones are converted into microphone signals. When the sound signals have a frequency below a threshold frequency, an output signal is generated from microphone signals generated by the one or more front-facing microphones and the plurality of secondary microphones. When the sound signals have a frequency at or above a threshold frequency, an output signal is generated from microphone signals generated by only the one or more front-facing microphones.

Example Embodiments

As noted, collaboration endpoints typically include an integrated microphone system that is used to receive/capture (i.e., pickup) sound signals (audio) from within an audio environment (e.g., meeting room). For a collaboration endpoint with an integrated microphone system, the audio or sound (e.g., the voice quality) can, in many cases, be improved by using a directional microphone or microphone array. In certain sound environments, such as offices with open floor plans, it may be desirable to avoid capturing sound from sources located the sides and/or behind the endpoint.

One solution to such problems is to use directional microphones, such as electret microphone or a micro-electro-mechanical systems (MEMS) microphone, within a collaboration endpoint. However, integrating such directional microphones in a typical collaboration endpoint is challenging and/or limiting to the industrial design. For example, directional microphones typically need to have near free-field conditions to work as intended. However, mechanical integration of the directional microphones into the physical structure of the collaboration endpoint may prevent the microphones from experiencing near free-field conditions which, accordingly, can seriously impact the directional characteristics of the microphone elements. Also, directional microphones are typically much more sensitive to vibration than omnidirectional microphones, which is a significant drawback for use in collaboration endpoints with integrated loudspeakers.

A microphone array formed by a plurality of omnidirectional microphones can also achieve a directional sensitivity (directional pick-up pattern). In such arrangements, the microphone signals from each of the omnidirectional microphones are combined using array processing techniques. For example, in certain conventional collaboration endpoints, a broadside microphone array is implemented, where the plurality of omnidirectional microphones are all placed at the front surface of the endpoint, and span a substantial width of the front surface of the endpoint. The "front" surface of the collaboration is the surface of the collaboration endpoint that faces (i.e., is oriented towards) the general area where sound sources are likely to be located. For example, if a collaboration endpoint is positioned along a side, wall, etc. of a conference room, the front surface of the collaboration endpoint will generally be the surface of the collaboration that faces towards the remainder of the conference room (i.e., the surface facing towards the location of target sound sources, such as meeting participants), while the "back" or "rear" surface of the collaboration endpoint is the surface that faces away from the target sound sources (e.g., towards the side, wall, etc.) The "top" surface of the collaboration endpoint is a surface that is substantially orthogonal to the front surface of the collaboration endpoint and, accordingly, orthogonal to the primary arrival direction of sound signals from the target sound sources. Stated differently, the top surface is the surface of the collaboration endpoint that generally faces upwards within a given sound environment. The "bottom" surface of the collaboration endpoint is a surface that is substantially orthogonal to the front surface of the collaboration endpoint, and accordingly, orthogonal to the primary arrival direction of sound signals from the target sound sources. Stated differently, the bottom surface is the surface of the collaboration endpoint that generally faces downwards within a given sound environment.

Broadside array processing techniques have limitations when used for compact designs and two or more microphones. For example, directionality may be limited, both in level and frequency range of attenuation, more microphones may need to be employed to improve directionality and effective frequency range, etc. As another example, it may be difficult to avoid placing microphones near loudspeakers in certain collaboration endpoint with integrated loudspeakers. This may cause high feedback levels from one or more of the loudspeakers to one or more of the microphones, which is a drawback in two-way communication systems (e.g., double-talk performance may be compromised). As another example, for a broadside microphone array, the pick-up pattern has rotational symmetry around the array, and there is front-back ambiguity, so the array may not attenuate sound from the rear side of the endpoint.

Presented herein are techniques that address problems associated with prior art arrangements through the use of an endfire microphone array with selective frequency processing. More specifically, the techniques presented herein achieve a desired directionality and audio pick-up quality over the entire voice frequency range using an "endfire microphone array" (i.e., a microphone array in which at least one microphone is positioned on a front surface of a collaboration endpoint and a plurality of microphones are positioned on a second surface of the collaboration endpoint, e.g., a top surface or a bottom surface of the collaboration endpoint) with selective frequency processing techniques. With an endfire array, microphones positioned on the front surface of a collaboration endpoint are sometimes referred to herein as "front-facing" microphones, while microphones positioned on the second surface of a collaboration endpoint are sometimes referred to herein as "secondary" microphones. The endfire array, and associated processing, enables attenuation over a wider frequency range and to the rear and sides of the collaboration endpoint.

A problem with endfire arrays is that there will often be no line of sight between the top-facing microphones and the sound sources (e.g., persons) located in front of the collaboration endpoint. This lack of line of sight results in a "shadowing" of the top-facing microphones, relative to the sound sources. Due to the physics of sound wave propagation, low frequency signals are able to bend around obstacles, thus the shadowing of the top-facing microphones, relative to the sound sources does not greatly impact the ability of the top-facing microphones to receive the low frequency content of the sound signals. However, high frequency signals have a limited ability to bend around obstacles, which affects the ability of the top-facing microphones to receive the high frequency content of the sound signals. That is, the frequency content of the sound signals may be attenuated due to the shadowing effect caused by the physical size of the endpoint and the physics of sound wave propagation, and the sound signals may sound muffled on the far end. Making the volume in the interior of the endpoint acoustically transparent to remove the shadowing effect is mechanically challenging.

The selective frequency processing techniques herein address problems associated with endfire arrays. More specifically, in accordance with certain embodiments presented herein, when the sound signals received at a collaboration endpoint have a frequency below a threshold frequency, an output signal is generated from both the sound signals received at the front-facing microphones and the sound signals received at the secondary microphones. However, when the sound signals have a frequency at or above a threshold frequency, an output signal is generated only from sound signals received at front-facing microphones.

Figure 1B:
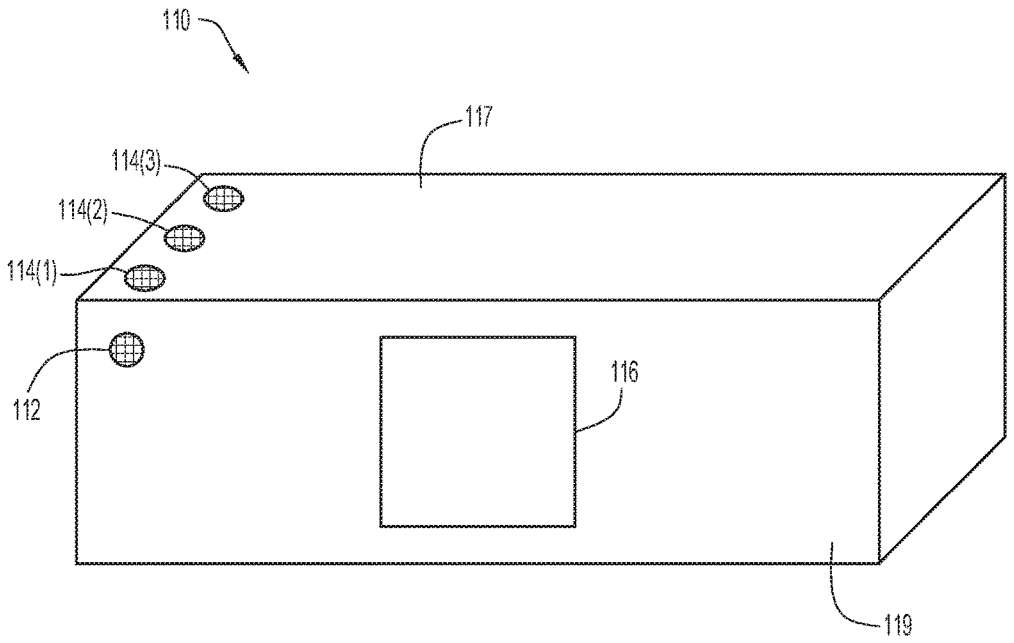
FIG. 1B is a schematic view of the collaboration endpoint of FIG. 1A.
Figure 1C:
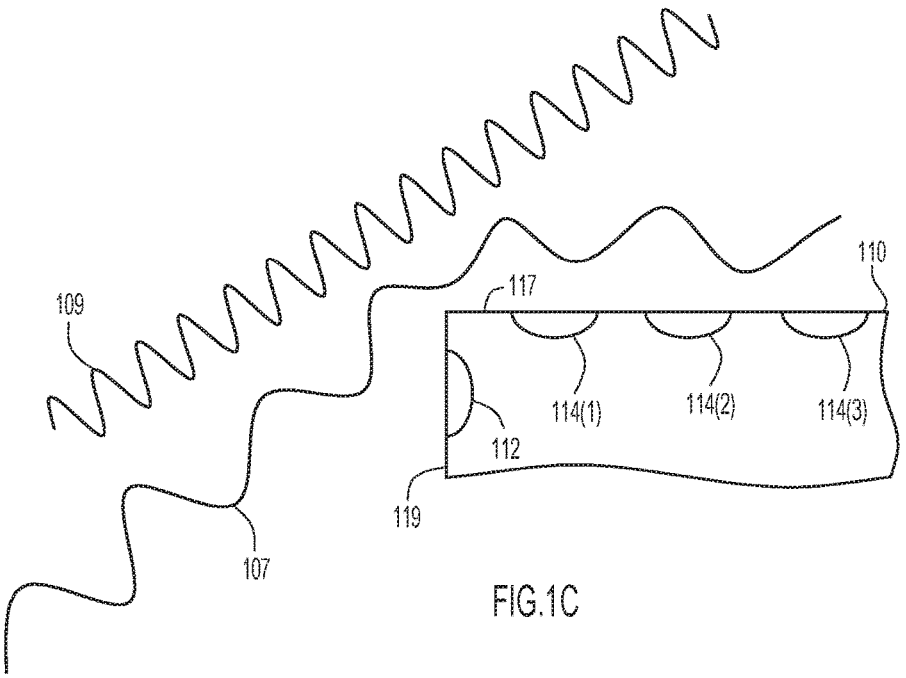
FIG. 1C is a side view of a portion of the collaboration endpoint of FIG. 1A.

Referring to FIG. 1A, shown is a simplified block diagram of a collaboration endpoint 110, in accordance with embodiments presented herein. FIG. 1B is a schematic view of the collaboration endpoint 110, while FIG. 1C is side view of a portion of the collaboration endpoint 110. For ease of description, FIGS. 1A-1C will generally be described together. The collaboration endpoint includes a plurality of microphones, including one or more front-facing microphones and a plurality of secondary microphones. The secondary microphones could be top-facing microphones or bottom-facing microphones depending on how the collaboration endpoint is mounted/positioned with a given sound environment.

The collaboration endpoint 110 is part of a collaboration system 100, which is positioned in a sound environment 101. The collaboration system 100 includes the collaboration endpoint 110 and a display 120. The collaboration endpoint 110 comprises a camera 116 and a plurality of microphones, including a front-facing microphone 112 and a plurality of top-facing microphones, referred to as top-facing microphones 114(1), 114(2), and 114(3). In this example, the plurality of secondary microphones are disposed on a top surface 117 of the collaboration endpoint 110, and as such, the secondary microphones are described with respect to FIGS. 1A-1C and FIG. 2 as being "top-facing" microphones. However, it is to be appreciated that, in other embodiments, the plurality of secondary microphones could be disposed on a bottom surface of the collaboration endpoint 110. For example, if the collaboration endpoint 110 were mounted/positioned below the display 120, the plurality of secondary microphones would be disposed on a bottom surface of the collaboration endpoint 110. The collaboration endpoint 110 is electrically connected to the display 120.

The front-facing microphone 112 is disposed on a front surface 119 of the collaboration endpoint 110. The top-facing microphones 114(1), 114(2), and 114(3) are disposed on a top surface 117 of the collaboration endpoint 110. The front surface 119 is, for example, substantially orthogonal to the top surface 117. In operation, the front-facing microphone 112 and the top-facing microphones 114(1), 114(2), and 114(3) form a microphone array 115 that is configured to receive/capture sound signals (audio) from sound sources located in the sound environment 101.

In some example embodiments, the front-facing microphone 112 and the top-facing microphones 114(1), 114(2), and 114(3) are disposed on the collaboration endpoint such that these microphones form an L-shape endfire microphone array 115. The front microphone 112 in an L-shape endfire microphone array 115 enables beamforming to work well up to a substantially higher frequency than for the corresponding linear array with all microphones shadowed. Moreover, such an endfire configuration may help maximize the distance between the microphone array and the nearest loudspeaker of the collaboration endpoint 110 (if the endpoint 110 includes loudspeakers), which may improve double-talk performance.

Also shown in FIG. 1A are local participants 103(1) and 103(2). The local participants 103(1) and 103(2) may be in a meeting room in which collaboration system 100 is located and are the target sound sources for the microphone array 115. As shown in FIG. 1A, sound signals 105 originating from the meeting room participant 103(1) have a "line of sight" 111, or a direct audio path, to the front-facing microphone 112. As such, when the participant 103(1) speaks, the substantially entire frequency spectrum of the sound waves ("sound signals," "sound," or "audio") from the participant's voice travels to, and is detected by, the front-facing microphone 112. However, as explained in more detail below, the full frequency spectrum of sound signals originating from in front of the collaboration endpoint 110 (e.g., sound signals 105) may not be received by the top-facing microphones 114(1), 114(2), and 114(3). For example, low-frequency sound signals (e.g., originating from in front of the collaboration endpoint 110) may be received by the front-facing microphone 112 and the top-facing microphones 114(1), 114(2), and 114(3), while high-frequency sound signals (e.g., originating from in front of the collaboration endpoint 110) may be received by only the front-facing microphone 112. Such high-frequency sound signals may be blocked from being received by the by the top-facing microphones 114(1), 114(2), and 114(3) due to the "shadowing effect."

For example, as shown in FIG. 1C, low frequency sound signals 107, due to their long wavelength, bend readily around to the top surface of the collaboration endpoint 110. As such, the low frequency sound signal 107 is largely unaffected by the presence of the collaboration endpoint 110. That is, the collaboration endpoint 110 is more or less transparent to the top-facing microphones 114(1), 114(2), and 114(3) with respect to low frequency sound signals originating from in front of and/or below the collaboration endpoint. The low frequency sound signal 107 thus can be detected by front-facing microphone 112 as well as the top-facing microphones 114(1), 114(2), and 114(3). However, the high frequency sound signal 109, due to its shorter wavelength, tends to be reflected by the collaboration endpoint 110. That is, unlike the low frequency sound signal 107, the high frequency sound signal 109 is not detected by the top-facing microphones 114(1), 114(2), and 114(3). The collaboration endpoint 110 (e.g., the front surface of the collaboration endpoint 110) effectively blocks the high frequency sound signal 109 from reaching the top-facing microphones 114(1), 114(2), and 114(3). The high frequency sound signal 109 thus may only be received by the front facing microphone 112.

Therefore, as described elsewhere herein, the collaboration endpoint 110 is configured to implement "selective frequency processing" techniques. In the selective frequency processing techniques presented herein, array processing (e.g., one or more beamforming techniques) is used to generate an output signal from the sound signals received at the front-facing microphone 112 and at the plurality of top-facing microphones 114(1), 114(2), and 114(3) for sound signals having a frequency that at or below including a threshold frequency (e.g., up to approximately eight (8) kilohertz (kHz)). However, in the selective frequency processing techniques, for sound signals having a frequency that is above the threshold frequency, only the sound signals received at the front-facing microphone are used to generate the output signal. This improves the high frequency performance of the microphone array 115, since the front-facing microphone 112 may have no high frequency loss, but the top-facing microphones 114(1), 114(2), and 114(3) may have significant high frequency loss due to shadowing of the sound source. As noted above, shadowing occurs because a sound source (of interest) is typically in front of the system 100, without a direct line of sight to the top-facing microphones 114(1), 114(2), and 114(3). The effect of shadowing is frequency dependent, and loss of level may gradually increase with increasing frequency. The microphone array 115, with selective frequency processing, allows for good directionality up to the threshold frequency, attenuating sound from the sides and rear of the unit. Above the threshold frequency, sound from the rear and sides may be attenuated by the shadowing effect created by the physical dimensions of the collaboration endpoint 110 and possibly the display 120, which the collaboration endpoint 110 may be mounted on. The relative attenuation may be enhanced by the pressure zone effect experienced by sound waves from the front or wanted/desired direction, due to the front surface of the collaboration endpoint 110 and possibly the display 120.

In the example of FIG. 1A, the camera 116 is front-facing and may capture the meeting participants 103(1) and 103(2). The microphone array 115 may be configured so as to have a directionality that matches or coincides with a field of view (FOV) of the camera 116. For example, the FOV of the camera 116 may be 120 degrees, and the microphone array 115 response is within −6 dB in the camera FOV. Damping to the sides (e.g., 90 degrees) and rear (e.g., 180 degrees) of the collaboration endpoint 110 is theoretically in the range of −20 dB. An effective frequency range of the array processing may be, for example, 200 HZ to 8 kHz.

In certain embodiments, the endfire configuration of microphone array 115 may also provide options for increased "smartness" in the microphone processing. For example, presence of audio sources with a distinct incoming direction from behind or the sides, but outside the pickup sector of the camera 116, can be detected. This information can be combined with face tracking in the camera processing, and utilized to further attenuate sound from unwanted directions.

If the collaboration system 100 and/or the collaboration endpoint 110 is located in an open space, the microphone array 115 may attenuate unwanted sound from the sides and rear of the endpoint 110. In huddle rooms or small conference rooms, the array 115 may improve speech pick up quality since reverberation levels are reduced by the directional pick-up pattern. Reverberation in small rooms can be detrimental to the sound quality of speech picked up by a microphone. The directionality of the array 115, for example, extends the useful pickup range of the integrated microphones, and without the need for external microphones possible in a number of scenarios. This may lead to, for example, higher user or customer satisfaction. Also, increased directionality may be beneficial for automatic speech recognition.

Although FIG. 1A and FIG. 1B show the collaboration endpoint 110 as including a camera 116, it is to be understood that the collaboration endpoint 110 and the camera 116 may be separate devices. Further, although FIG. 1A shows the collaboration endpoint 110 as being separate from the display 120, it is to be understood that the collaboration endpoint 110 and the display 120 may be integrated together in a single device. Additionally, in some example embodiments, the collaboration system 100 may not include the camera 116 and/or the display 120.

Figure 2:
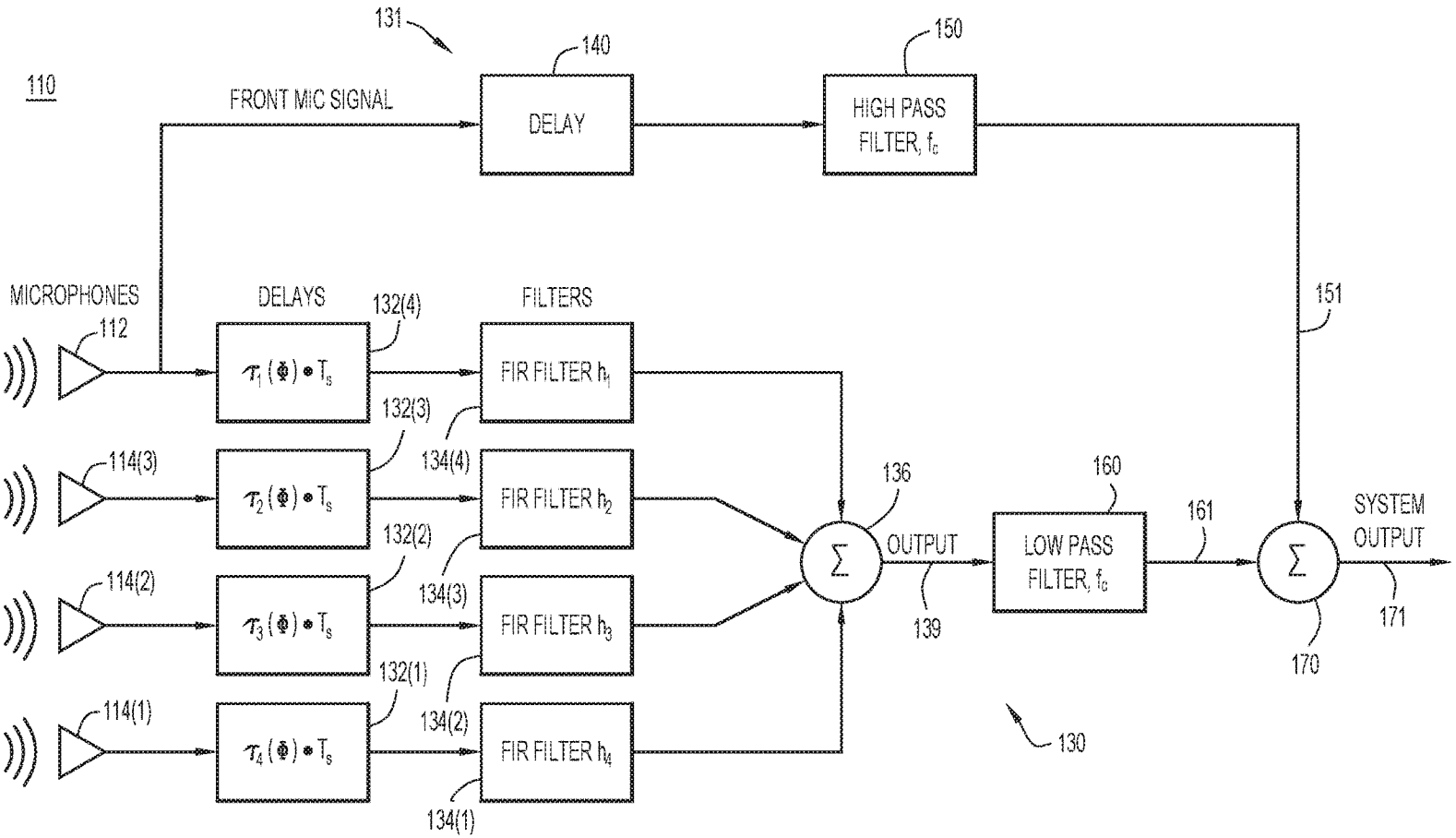
FIG. 2 is a simplified functional diagram illustrating processing blocks of the collaboration endpoint of FIG. 1A, according to an example embodiment.

Referring next to FIG. 2, shown is a functional block diagram illustrating processing blocks implemented by the collaboration endpoint 110, according to an example embodiment. In this example, the processing blocks of the collaboration endpoint 110 include a beamformer 130, a front processing stage 131, a low pass filter 160, and an output module 170. The front processing stage 131 includes a delay unit 140 and a high pass filter 150, while the beamformer 130 includes delay units 132(1), 132(2), 132(3), and 132(4), filters 134(1), 134(2), 134(3), and 134(4) (e.g., finite impulse response filters), and a combiner 136.

As shown in FIG. 2, each of the microphones 112 and 114(1)-114(3) receive sound signals. The microphones 112 and 114(1)-114(3) are each configured to convert the respective received sound signals into digital signals, sometimes referred to herein as microphone signals. The microphone signals generated by the front-facing microphone 112, sometimes referred to herein as front-facing microphone signals, are provided to the front processing stage 131. As noted, the front processing stage 131 includes a delay unit 140, which delays the front-facing microphone signals, and includes a high-pass filter 150. As such, the front processing stage 131 to produces a delayed and high-pass filtered version of the front-facing microphone signals, sometimes referred to herein as high-pass filtered front-facing signals 151. The front-facing microphone signals are delayed appropriately, for example, so that a phase(s) of the front-facing microphone signals matches a phase(s) of the (cross-over frequency) front-facing microphone signals used in generating beamformer signal/output 139, which is described in more detail below.

As shown in FIG. 2, the microphone signals generated by the top-facing microphones 114(1)-114(3), sometimes referred to herein as top-facing microphone signals, are provided to the beamformer 130. Similarly, the front-facing microphone signals generated by the font-facing microphone 112 are also provided to the beamformer 130. The beamformer 130 is configured to process the microphone signals from microphone 112 and from the top-facing microphones 114(1)-114(3) using at least one beamforming technique. Generally, the beamformer 130 may be configured to filter and sum the microphone signals from microphone 112 and from the top-facing microphones 114(1)-114(3) to generate an acoustic beam pointing at (focused to) a particular direction. As noted, the beamformer 130 includes delay units 132(1)-132(4) and filters 134(1)-134(4), which each operate on a corresponding set of the microphone signals. For example, delay unit 132(4) operates to delay the front-facing microphone signals, while each of the delay units 132(1), 132(2), and 132(3) operate to delay microphone signals from the top-facing microphones 114(1), 114(2), and 114(3), respectively. Each of the microphone signals 112 and 114(1)-114(3) may be delayed according to (based on) an angle of incidence of target sound source(s) corresponding to a desired focus/direction of sound pick-up. For example, in an endfire array configuration of the microphone array 115, each of the microphone signals 112 and 114(1)-114(3) may be delayed according to (based on) an angle of incidence of target sound source(s) with respect to the microphone array 115.

Additionally, filter 134(4) operates to filter the delayed front-facing microphone signals, while each of filters 134(1), 134(2), and 134(3) operate to filter the delayed microphone signals from the top-facing microphones 114(1), 114(2), and 114(3), respectively (i.e., filter the outputs of delay units 132(1), 132(2), and 132(3), respectively). Coefficients of filters 134(1), 134(2), 134(3), and 134(4) may be calculated by defining a multiply constrained optimization problem. Constraints may include, for example, one or more of array geometry, desired beam width, desired frequency range, attenuation of side lobes, array output power, etc. The delayed and filter microphone signals from each of the microphones 112 and 114(1)-114(3) are provided to combiner 136. The combiner 136 combines the delayed and filtered microphone signals to generate a beamformer signal/output 139.

As shown in FIG. 2, the beamformer signal 139 is provided to a low-pass filter 160, which generates a low-pass filtered beamformer signal 161. The low-pass filtered beamformer signal 161, as well as the high-pass filtered front-facing signals 151 from front processing stage 131, are provided to the output module 170. The output module 170 generates a system output signal 171 from the low-pass filtered beamformer signal 161 and the high-pass filtered front-facing signals 151. In general, the system output signal 171 is formed from (based on) the sound signals received at the front-facing microphone 112, and the sound signals received at the top-facing microphone signals 114(1)-114(3), when the sound signals received within a given time frame have a frequency below a predetermined threshold frequency. However, the system output signal 171 is formed from (based on) the sound signals received only at the front-facing microphone 112 when the sound signals received within a given time frame have a frequency at or above a predetermined threshold frequency.

More specifically, the high pass filter 150 and/or the low pass filter 160 may filter microphone signals based on the predetermined threshold frequency. For example, the high pass filter 150 may allow signals having a frequency greater than or equal to the threshold frequency to pass, while blocking lower frequency signals. Conversely, the low pass filter 160 may allow signals having a frequency less than the threshold frequency to pass, while blocking higher frequency signals. Therefore, when the sound signals received at the microphones 112 and 114(1)-114(3), during a given time frame, have a high frequency (i.e., at or above the threshold frequency), the system output signal 171 generally corresponds to the high-pass filtered front-facing signals 151. However, when the sound signals received at the microphones 112 and 114(1)-114(3), during a given time frame, have a low frequency (i.e., below the threshold frequency), the system output signal 171 is combination of the low-pass filtered beamformer signal 161 and the high-pass filtered front-facing signals 151. A usable upper frequency of the beamformer 130 may be determined by (based on) the geometry of the microphone array 115.

In summary, FIG. 2 illustrates an example arrangement in which sound signals are received by at least one front-facing microphone 112 disposed on a front surface 119 of a collaboration endpoint 110, and by a plurality of top-facing microphones 114(1)-114(3) disposed on a top surface 117 of the collaboration endpoint 110. When (i.e., during a given time period) the received sound signals have a frequency below a threshold frequency, an output signal is generated from microphone signals generated by the at least one front-facing microphone 112 and from microphone signals generated the plurality of top-facing microphones 114(1)-114(3). When (i.e., during a given time period) the received sound signals have a frequency at or above a threshold frequency, an output signal is generated from microphone signals generated by only the at least one front-facing microphone 112.

FIG. 2 is merely illustrative of one example processing arrangement for implementation of the selective frequency processing techniques presented herein. As such, it is to be appreciated that the techniques presented herein may be implemented with different processing arrangements that include other combinations of processing blocks/modules which may differ from that shown in FIG. 2.

Figure 3:
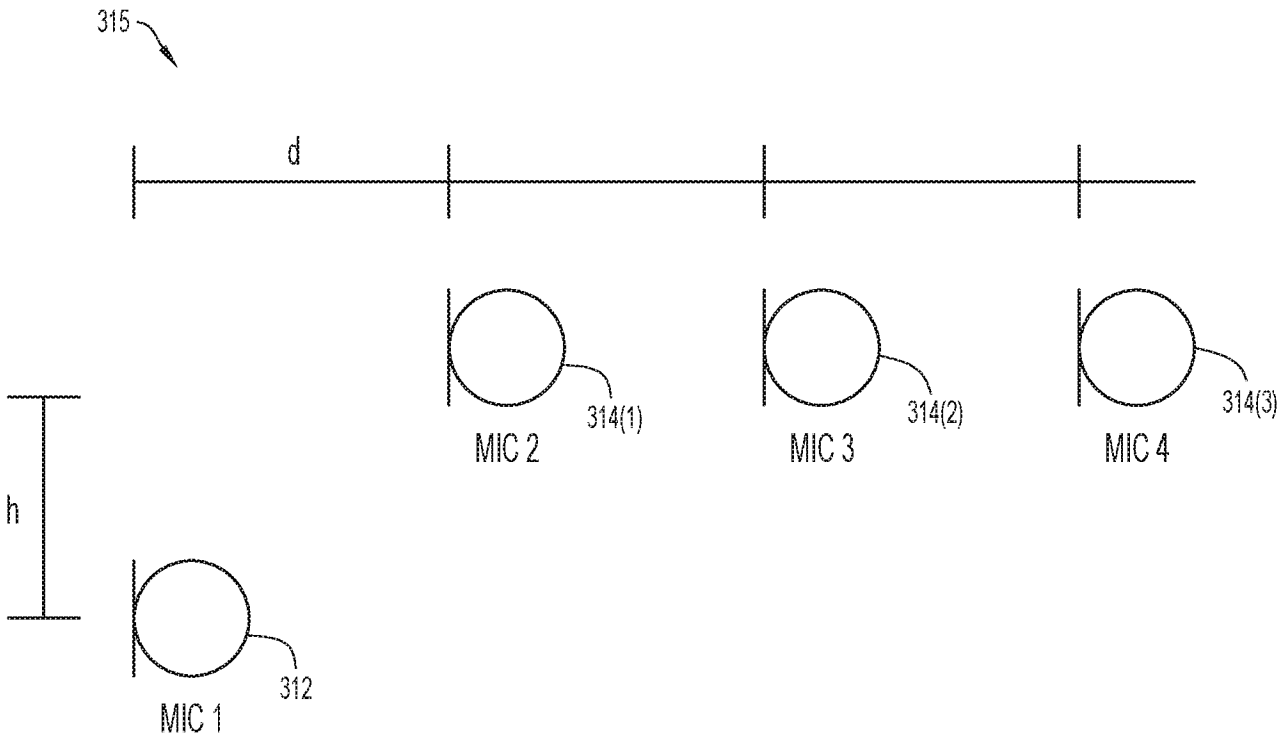
FIG. 3 is a simplified diagram of an L-shaped endfire microphone array, according to an example embodiment.

The selective frequency processing techniques presented herein may be implemented within a number of different microphones. However, in certain examples, the selective frequency processing techniques may be advantageously implemented with an L-shaped endfire microphone array, an example of which is shown in FIG. 3. More specifically, FIG. 3 is a simplified diagram of an L-shaped endfire microphone array 315, which includes a first microphone 312 and microphones 314(1), 314(2), and 314(3). For ease of illustration, the microphones 312 and 314(1), 314(2), and 314(3) are shown separate from a support structure, such as a collaboration endpoint. The microphones 312 and 314(1), 314(2), and 314(3) are each omnidirectional microphones.

In the example of FIG. 3, the microphones 314(1), 314(2), and 314(3) are aligned along a first elongate axis and are sometimes referred to as being "on-axis." In contrast, the microphone 312 is not positioned on the same axis as microphones 314(1), 314(2), and 314(3) and is sometimes referred to as being "off-axis." In other words, the microphones 314(1), 314(2), 314(3) form an in-line microphone array with respect to a common axis, while the microphone 312 is offset from the common axis. The microphones 312, 314(1), 314(2), and 314(3) are equally spaced a distance 'd' from each other relative to the common axis. As shown in FIG. 3, with respect to the common axis, the microphone 312 is a distance 'd' from the microphone 314(1), which is the distance 'd' from the microphone 314(2), which is the distance 'd' from the microphone 314(3). The microphone 312 is offset from the common axis a distance 'h'.

Figure 4:
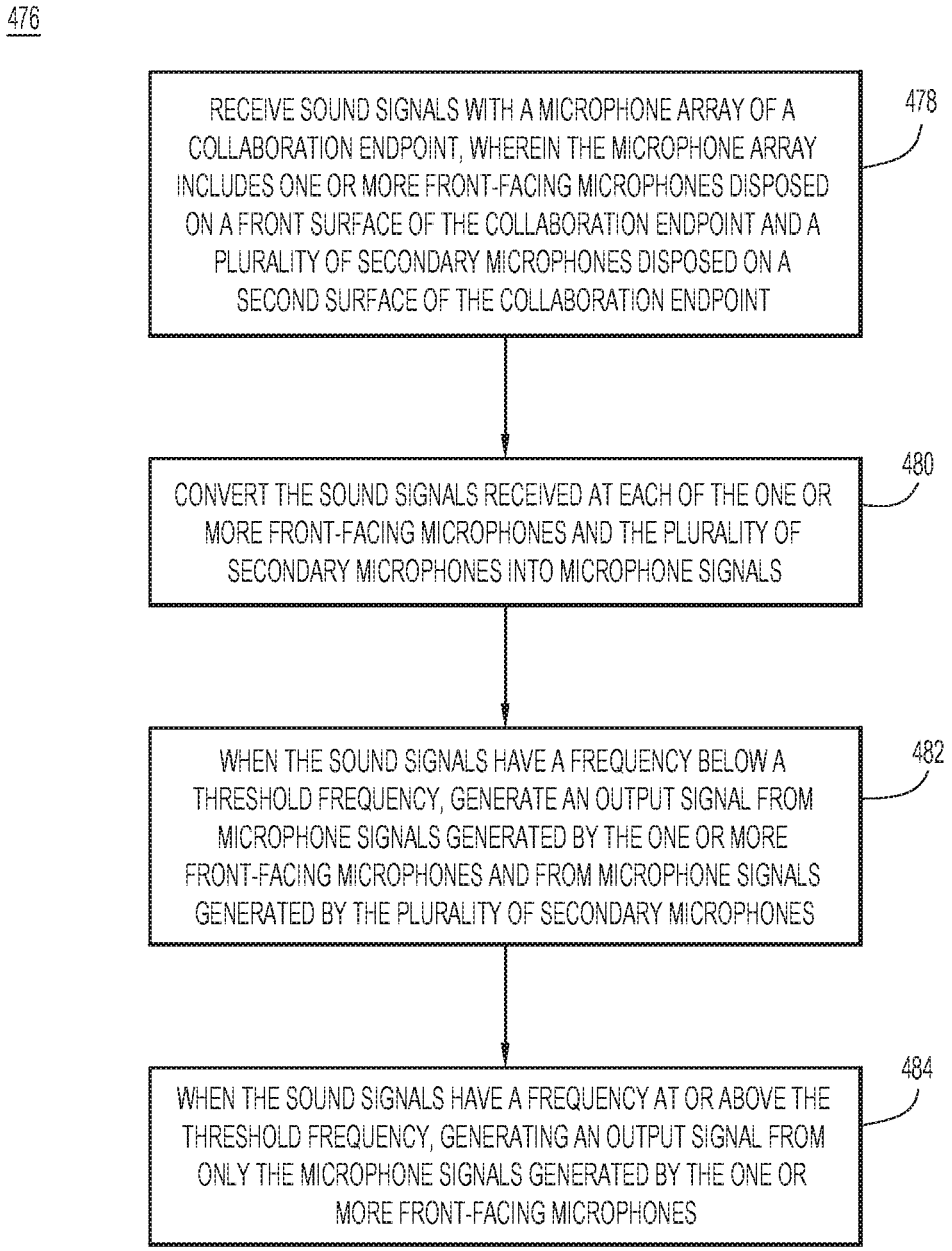
FIG. 4 is a flowchart illustrating a method, according to an example embodiment.

Referring next to FIG. 4, shown is a flowchart of an example method 476 in accordance with embodiments presented herein. Method 476 may be performed, for example, by a collaboration endpoint, such as collaboration endpoint 110.

Method 476 begins at 478 where sound signals are received with a microphone array of a collaboration endpoint. The microphone array includes one or more front-facing microphones disposed on a front surface of the collaboration endpoint and a plurality of secondary microphones (e.g., top-facing microphones or bottom-facing microphones) disposed on a second surface of the collaboration endpoint (e.g., a top surface or a bottom surface of the collaboration endpoint).

At 480, the sound signals received at each of the one or more front-facing microphones and the plurality of top-facing microphones are converted into microphone signals. At 482, when the sound signals have a frequency below a threshold frequency, an output signal is generated from microphone signals generated by the one or more front-facing microphones and from microphone signals generated by the plurality of secondary microphones. At 484, when the sound signals have a frequency at or above the threshold frequency, an output signal is generated from only the microphone signals generated by the one or more front-facing microphones.

Figure 5:
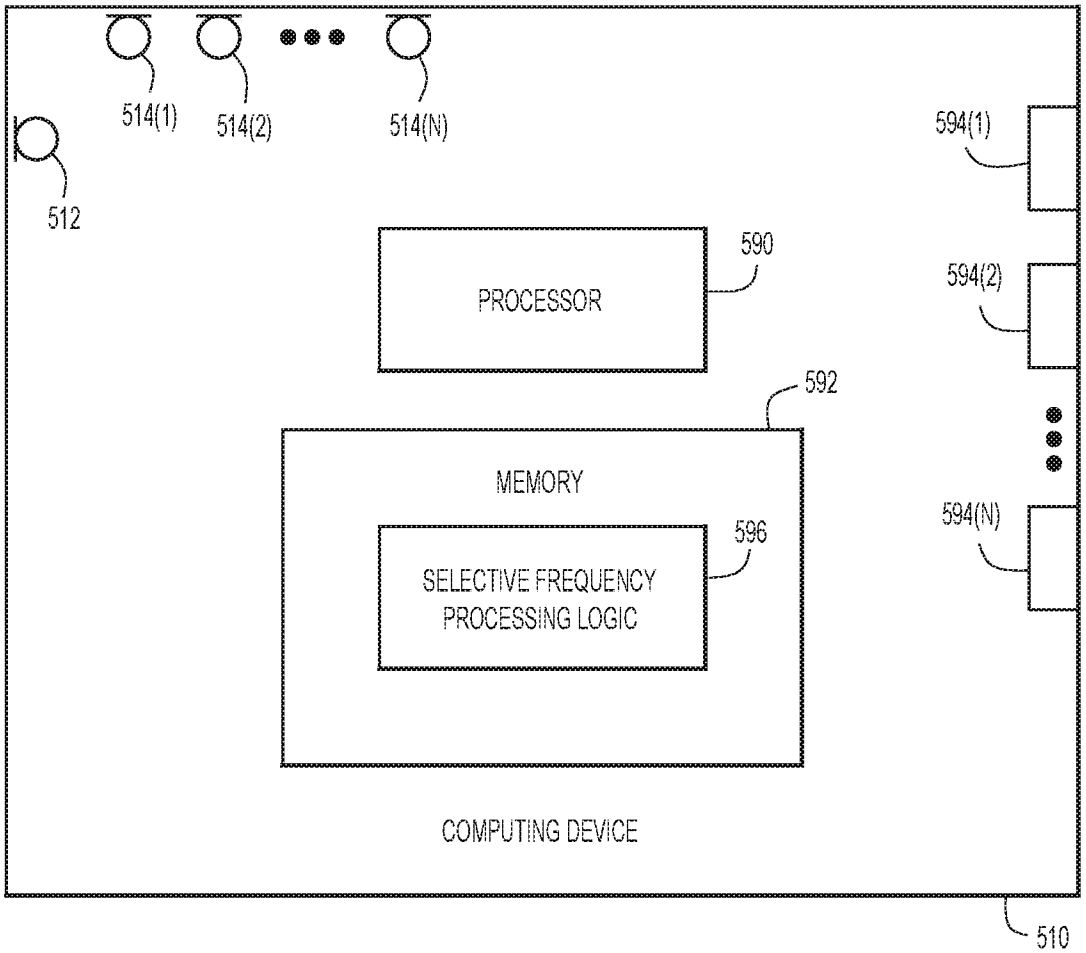
FIG. 5 is a simplified block diagram of a computing device configured to implement the techniques presented herein, according to an example embodiment.

FIG. 5 is simplified block diagram of a computing device 510, such as a collaboration endpoint, that is configured to implement the selective frequency processing techniques presented herein. More specifically, the computing device 510 comprises a microphone array 115, which includes a primary microphone 512 and a plurality of secondary microphones 514(1)-514(N). The primary microphone 512 is positioned on/at a first outer surface 519 of the computing device 510, while the plurality of secondary microphones 514(1)-514(N) are positioned at a second outer surface 517 of the computing device 510. The first outer surface 519 is substantially orthogonal to the second outer surface 517.

The computing device 510 further comprises at least one processor 590 (e.g., at least one Digital Signal Processor (DSP), at least one uC core, etc.), at least one memory 592, and a plurality of interfaces or ports 594(1)-594(N). The memory 592 stores executable instructions selective frequency processing logic 596 which, when executed by the at least one processor 590, causes the at least one processor to perform the selective frequency processing operations described herein on behalf of the computing device 510.

The memory 592 may include read only memory (ROM), random access memory (RAM), magnetic disk storage media devices, optical storage media devices, flash memory devices, electrical, optical, or other physical/tangible memory storage devices. Thus, in general, the memory 592 may comprise one or more tangible (non-transitory) computer readable storage media (e.g., a memory device) encoded with software comprising computer executable instructions and when the software is executed (by the at least one processor 590) it is operable to perform the operations described herein.

As noted above, presented herein are techniques for selective frequency processing of sound signals received at a microphone array comprising microphones positioned on different surfaces of a computing device, such as a collaboration endpoint. The techniques described herein may be used, for example, to enable high performance implementations of an endfire microphone array in a compact video collaboration endpoint. The techniques presented herein may provide suppression of sound from the sides and rear of the collaboration endpoint, while providing high quality speech pickup across the whole audible frequency range (e.g., in an area closely matching a field of view of a camera). This is enabled by the physical integration of an endfire microphone array in the collaboration endpoint, combined with selective frequency processing adapted to the physical array design.

In one aspect, a method is provided. The method comprises: receiving sound signals with a microphone array of a collaboration endpoint, wherein the microphone array includes one or more front-facing microphones disposed on a front surface of the collaboration endpoint and a plurality of top-facing microphones disposed on a top surface of the collaboration endpoint; converting the sound signals received at each of the one or more front-facing microphones and the plurality of top-facing microphones into microphone signals; when the sound signals have a frequency below a threshold frequency, generating an output signal from microphone signals generated by the one or more front-facing microphones and from microphone signals generated by the plurality of top-facing microphones; and when the sound signals have a frequency at or above the threshold frequency, generating an output signal from only the microphone signals generated by one or more front-facing microphones.

In certain embodiments, the front surface of the collaboration endpoint is substantially orthogonal to the top surface of the collaboration endpoint. In certain embodiments, the plurality of top-facing microphones disposed on the top surface of the collaboration endpoint form an in-line microphone array. In further embodiments, at least one of the one or more front-facing microphones is offset from the in-line microphone array such that the at least one front-facing microphone and the in-line microphone array form an L-shaped microphone array. In certain embodiments, at least one of the one or more front-facing microphones and at least two of the plurality of top-facing microphones form an L-shaped endfire microphone array. In certain embodiments, the plurality of top-facing microphones are substantially equally spaced from each other relative to a common axis. In further embodiments, at least one of the one or more front-facing microphones is offset from the common axis. In certain embodiments, the method comprises: high pass filtering, based on the threshold frequency, the microphone signals generated by the one or more front-facing microphones to generate high-pass filtered front-facing signals; generating, using a beamforming technique, a beamformer signal from the microphone signals generated by the at least one front-facing microphone and the microphone signals generated by the plurality of top-facing microphones; low pass filtering the beamformer signal based on the threshold frequency to remove frequency components at or above the threshold frequency; and combining the beamformer signal and the high-pass filtered front-facing signals.

In certain embodiments, the plurality of top-facing microphones are substantially equally spaced from each other relative to a common axis. In further embodiments, at least one of the one or more front-facing microphones is offset from the common axis.

In one aspect, an apparatus is provided. The apparatus comprises: a front surface and a top surface; a microphone array including one or more front-facing microphones positioned at the front surface and a plurality of top-facing microphones positioned at the top surface, wherein the one or more front-facing microphones and the plurality of top-facing microphones are configured to receive sound signals and to convert the sound signals received at each of the one or more front-facing microphones and the plurality of top-facing microphones into microphone signals; and one or more processors configured to: when the sound signals have a frequency below a threshold frequency, generate an output signal from microphone signals generated by the one or more front-facing microphones and from microphone signals generated by the plurality of top-facing microphones, and when the sound signals have a frequency at or above the threshold frequency, generate an output signal from only the microphone signals generated by one or more front-facing microphones.

In one aspect, provided is one or more non-transitory computer readable storage media encoded with instructions that are executed by a processor in a collaboration endpoint that includes a microphone array configured to receive sound signals, wherein the microphone array includes one or more front-facing microphones disposed on a front surface of the collaboration endpoint and a plurality of top-facing microphones disposed on a top surface of the collaboration endpoint. When the instructions encoded in one or more non-transitory computer readable storage media are executed by a processor, the processor is configured to: when the sound signals received by the microphone array have a frequency below a threshold frequency, generate an output signal from sound signals received by the one or more front-facing microphones and from sound signals received by the plurality of top-facing microphones; and when the sound signals received at the microphone array have a frequency at or above the threshold frequency, generate an output signal from only the sound signals received at the one or more front-facing microphones.

In certain embodiments, the sound signals received at each of the one or more front-facing microphones are converted into front-facing microphone signals and the sound signals received at each of the plurality of top-facing microphones are converted into top-facing microphone signals and wherein the one or more non-transitory computer readable storage media are encoded with instructions that, when executed by the processor, cause the processor to: high pass filter, based on the threshold frequency, the front-facing microphone signals to generate high-pass filtered front-facing signals; generate, using a beamforming technique, a beamformer signal from the front-facing microphone signals and from the top-facing microphone signals; low pass filter the beamformer signal based on the threshold frequency to remove frequency components at or above the threshold frequency; and combine the beamformer signal and the high-pass filtered front-facing signals to generate an output signal.

In certain embodiments, wherein the one or more non-transitory computer readable storage media are encoded with instructions that, when executed by a processor, cause the processor to: prior to high-pass filtering the front-facing microphone signals, delay the front-facing microphone signals so that a phase of the front-facing microphone signals used to generate the high-pass filtered front-facing signals substantial matches a phase of the front-facing microphone signals used to generate the beamformer signal.

In certain embodiments, the instructions operable to generate a beamformer signal from the front-facing microphone signals and from the top-facing microphone signals comprise instructions that, when executed by the processor, cause the processor to: delay each of the front-facing microphone signals and the top-facing microphone signals, where the delays are based on an angle of incidence of the sound signals relative to a target direction.

The above description is intended by way of example only. Although the techniques are illustrated and described herein as embodied in one or more specific examples, it is nevertheless not intended to be limited to the details shown, since various modifications and structural changes may be made within the scope and range of equivalents of the claims.

What is claimed is:

1. A method comprising:

receiving sound signals with a microphone array of a collaboration endpoint, wherein the microphone array includes one or more front-facing microphones disposed on a front surface of the collaboration endpoint and a plurality of secondary microphones disposed on a second surface of the collaboration endpoint;

converting the sound signals received at each of the one or more front-facing microphones and the plurality of secondary microphones into microphone signals;

when the sound signals have a frequency below a threshold frequency, generating an output signal from microphone signals generated by the one or more front-facing microphones and from microphone signals generated by the plurality of secondary microphones; and when the sound signals have a frequency at or above the threshold frequency, generating an output signal from only the microphone signals generated by one or more front-facing microphones.

2. The method of claim 1, wherein the front surface of the collaboration endpoint is substantially orthogonal to the second surface of the collaboration endpoint.

3. The method of claim 1, wherein the plurality of secondary microphones disposed on the second surface of the collaboration endpoint form an in-line microphone array.

4. The method of claim 3, wherein at least one of the one or more front-facing microphones is offset from the in-line microphone array such that the at least one front-facing microphone and the in-line microphone array form an L-shaped microphone array.

5. The method of claim 1, wherein at least one of the one or more front-facing microphones and at least two of the plurality of secondary microphones form an L-shaped end-fire microphone array.

6. The method of claim 1, further comprising:

high pass filtering, based on the threshold frequency, the microphone signals generated by the one or more front-facing microphones to generate high-pass filtered front-facing signals;

generating, using a beamforming technique, a beamformer signal from the microphone signals generated by the one or more front-facing microphones and the microphone signals generated by the plurality of secondary microphones;

low pass filtering the beamformer signal based on the threshold frequency to remove frequency components at or above the threshold frequency; and combining the beamformer signal and the high-pass filtered front-facing signals.

7. The method of claim 1, wherein the plurality of secondary microphones are substantially equally spaced from each other relative to a common axis.

8. The method of claim 7, wherein at least one of the one or more front-facing microphones is offset from the common axis.

9. An apparatus comprising:

a front surface and a second surface;

a microphone array including one or more front-facing microphones positioned at the front surface and a plurality of secondary microphones positioned at the second surface, wherein the one or more front-facing microphones and the plurality of secondary microphones are configured to receive sound signals and to convert the sound signals received at each of the one or more front-facing microphones and the plurality of secondary microphones into microphone signals; and one or more processors configured to:

when the sound signals have a frequency below a threshold frequency, generate an output signal from microphone signals generated by the one or more front-facing microphones and from microphone signals generated by the plurality of secondary microphones, and when the sound signals have a frequency at or above the threshold frequency, generate an output signal from only the microphone signals generated by the one or more front-facing microphones.

10. The apparatus of claim 9, wherein the front surface is substantially orthogonal to the second surface.

11. The apparatus of claim 9, wherein the plurality of secondary microphones positioned at the second surface form an in-line microphone array.

12. The apparatus of claim 11, wherein at least one of the one or more front-facing microphones is offset from the in-line microphone array such that the at least one front-facing microphone and the in-line microphone array form an L-shaped microphone array.

13. The apparatus of claim 9, wherein at least one of the one or more front-facing microphones and at least two of the plurality of secondary microphones form an L-shaped end-fire microphone array.

14. The apparatus of claim 9, wherein the one or more processors are further configured to:

high pass filter, based on the threshold frequency, the microphone signals generated by the one or more front-facing microphones to generate high-pass filtered front-facing signals;

generate, using a beamforming technique, a beamformer signal from the microphone signals generated by the one or more front-facing microphones and the microphone signals generated by the plurality of secondary microphones;

low pass filter the beamformer signal based on the threshold frequency to remove frequency components at or above the threshold frequency; and combine the beamformer signal and the high-pass filtered front-facing signals.

15. The apparatus of claim 9, wherein the plurality of secondary microphones are substantially equally spaced from each other relative to a common axis.

16. The apparatus of claim 15, wherein at least one of the one or more front-facing microphones is offset from the common axis.

17. One or more non-transitory computer readable storage media encoded with instructions that, when executed by a processor in a collaboration endpoint that includes a microphone array configured to receive sound signals, wherein the microphone array includes one or more front-facing microphones disposed on a front surface of the collaboration endpoint and a plurality of secondary microphones disposed on a second surface of the collaboration endpoint, cause the processor to:

when the sound signals received by the microphone array have a frequency below a threshold frequency, generate an output signal from sound signals received by the one or more front-facing microphones and from sound signals received by the plurality of secondary microphones; and when the sound signals received at the microphone array have a frequency at or above the threshold frequency, generate an output signal from only the sound signals received at the one or more front-facing microphones.

18. The one or more non-transitory computer readable storage media of claim 17, wherein the sound signals received at each of the one or more front-facing microphones are converted into front-facing microphone signals and the sound signals received at each of the plurality of secondary microphones are converted into secondary microphone signals and wherein the one or more non-transitory computer readable storage media are encoded with instructions that, when executed by the processor, cause the processor to:

high pass filter, based on the threshold frequency, the front-facing microphone signals to generate high-pass filtered front-facing signals;

generate, using a beamforming technique, a beamformer signal from the front-facing microphone signals and from the secondary microphone signals;

low pass filter the beamformer signal based on the threshold frequency to remove frequency components at or above the threshold frequency; and combine the beamformer signal and the high-pass filtered front-facing signals to generate an output signal.

19. The one or more non-transitory computer readable storage media of claim 18, wherein the one or more non-transitory computer readable storage media are encoded with instructions that, when executed by a processor, cause the processor to:

prior to high-pass filtering the front-facing microphone signals, delay the front-facing microphone signals so that a phase of the front-facing microphone signals used to generate the high-pass filtered front-facing signals substantially matches a phase of the front-facing microphone signals used to generate the beamformer signal.

20. The one or more non-transitory computer readable storage media of claim 18, wherein the instructions operable to generate a beamformer signal from the front-facing microphone signals and from the secondary microphone signals comprise instructions that, when executed by the processor, cause the processor to:

delay each of the front-facing microphone signals and the secondary microphone signals, where the delays are based on an angle of incidence of the sound signals relative to a target direction.

* * * * *